US009091272B2

(12) United States Patent
Kim et al.

(10) Patent No.: US 9,091,272 B2
(45) Date of Patent: Jul. 28, 2015

(54) APPARATUS AND METHOD FOR CONTROLLING A COMPRESSOR

(71) Applicant: LG ELECTRONICS INC., Seoul (KR)

(72) Inventors: Gyunam Kim, Seoul (KR); Jaeyoo Yoo, Seoul (KR); Boram Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 113 days.

(21) Appl. No.: 13/749,981

(22) Filed: Jan. 25, 2013

(65) Prior Publication Data

US 2013/0195612 A1 Aug. 1, 2013

(30) Foreign Application Priority Data

Jan. 30, 2012 (KR) ..... 10-2012-0009079

(51) Int. Cl.

| | |
|---|---|
| ***H02P 1/00*** | (2006.01) |
| ***H02P 3/00*** | (2006.01) |
| ***H02P 5/00*** | (2006.01) |
| ***F04D 27/00*** | (2006.01) |
| ***F25B 49/02*** | (2006.01) |
| ***F04B 35/04*** | (2006.01) |
| ***F04D 27/02*** | (2006.01) |

(52) U.S. Cl.

CPC ..... *F04D 27/00* (2013.01); *F04B 35/045* (2013.01); *F04D 27/02* (2013.01); *F25B 49/025* (2013.01); *F25B 2600/021* (2013.01)

(58) Field of Classification Search

CPC ..... F25B 2600/021; F25B 49/025; F25B 2700/15

USPC ..... 318/119

See application file for complete search history.

(56) References Cited

U.S. PATENT DOCUMENTS

| | | | | |
|---|---|---|---|---|
| 6,367,273 | B2 * | 4/2002 | Takagi et al. | 62/230 |
| 6,737,847 | B2 * | 5/2004 | Watanabe et al. | 323/288 |
| 7,408,310 | B2 * | 8/2008 | Hong et al. | 318/119 |
| 8,100,668 | B2 * | 1/2012 | Yoo et al. | 417/44.11 |
| 8,550,789 | B2 * | 10/2013 | Hu et al. | 417/44.11 |
| 8,657,585 | B2 * | 2/2014 | Hong et al. | 417/44.11 |

* cited by examiner

*Primary Examiner* — Erick Glass

(74) *Attorney, Agent, or Firm* — Ked & Associates LLP

(57) ABSTRACT

An apparatus and method for controlling a compressor are provided. A motor current flowing in a compressor may be calculated from voltage values of a capacitor without using a sensor, and as a motor current value is calculated by changing voltage values of the capacitor according to voltage values of a drive and performing a definite integral thereon, the motor current value may be resistant to noise, and the compressor may be more stably controlled.

17 Claims, 8 Drawing Sheets

APPARATUS AND METHOD FOR CONTROLLING A COMPRESSOR

CROSS-REFERENCE TO RELATED APPLICATION(S)

Pursuant to 35 U.S.C. §119(a), this application claims priority to Korean Application No. 10-2012-0009079, filed on Jan. 30, 2012, the contents of which is incorporated by reference herein in its entirety.

BACKGROUND

1. Field

An apparatus for controlling a compressor and a method for controlling a compressor are disclosed herein.

2. Background

Apparatuses and methods for controlling a compressor are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
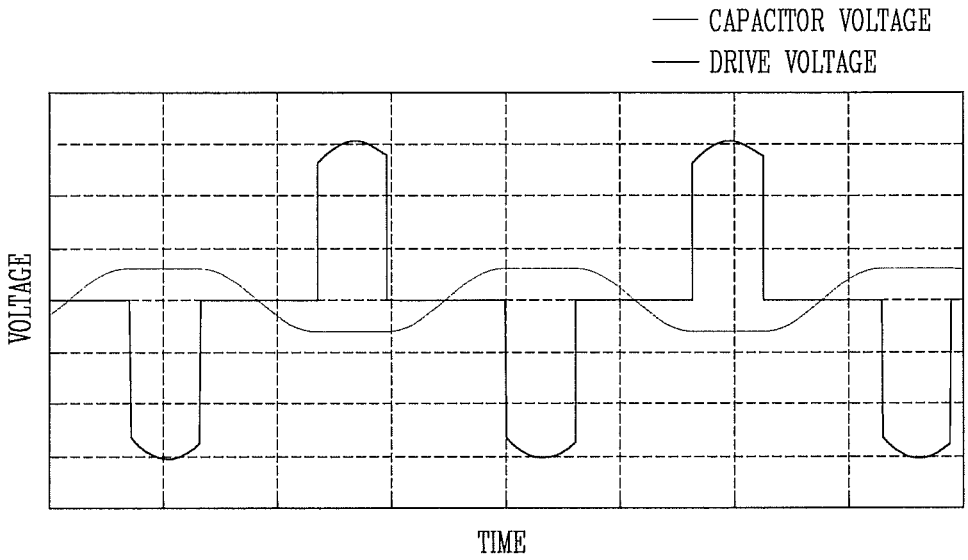
FIG. 1 is a graph showing capacitor voltage values and drive voltage values according to an embodiment.

Description will now be given in detail of embodiments, with reference to the accompanying drawings. For the sake of brief description with reference to the drawings, the same or equivalent components will be provided with the same reference numbers, and description thereof will not be repeated.

In general, a compressor, a device that converts mechanical energy into compression energy, may be used as part of refrigeration equipment, for example, a refrigerator, or an air-conditioner. A compressor may be classified as a reciprocating compressor, a rotary compressor, or a scroll compressor. In the reciprocating compressor, a compression space, into or from which an operating gas is sucked or discharged, is formed between a piston and a cylinder, and a piston linearly reciprocates within a cylinder to compressor a refrigerant. In the rotary compressor, a compression space, into or from which an operating gas is sucked or discharged, is formed between an eccentrically rotating roller, and a cylinder, and the roller eccentrically rotates along an inner wall of the cylinder to compress a refrigerant. In the scroll compressor, a compression space, into or from which an operating gas is sucked or discharged, is formed between an orbiting scroll and a fixed scroll, and the orbiting scroll rotates along the fixed scroll to compress a refrigerant.

In general, a reciprocating compressor, in which a piston linear reciprocates within a cylinder to suck, compress, and discharge a refrigerant gas, is classified as a recipro compressor and a linear compressor according to a method of driving a piston. The recipro compressor is a reciprocating compressor, in which a crank shaft is coupled to a rotary motor and a piston is coupled to the crank shaft to change rotatory power of the rotary motor into a linear reciprocal movement. The linear compressor is a reciprocating compressor in which a piston is directly connected to a mover of a linear motor to reciprocate a piston by a linear motion of the motor.

As described above, the linear compressor does not employ a crank shaft to convert a rotational motion to a linear motion, causing less frictional loss, so its performance is excellent relative to a general compressor in terms of compression efficiency. The linear compressor may be used in a refrigerator or an air-conditioner, to vary a voltage applied to a compressor to control a freezing capacity.

An apparatus for controlling a compressor generally detects a motor voltage and a motor current of a compressor motor to calculate a stroke, and controls a compressor based on the calculated stroke. Thus, in order to control a compressor, the motor current flowing in the reciprocating compressor is required to be continuously detected. To this end, in general, the apparatus for controlling a compressor detects a motor current flowing in the reciprocating compressor by means of a unit, such as a current transformer (CT).

Hereinafter, an apparatus for controlling a compressor and a method for controlling a compressor according to embodiments will be described in detail with reference to the accompanying drawings.

An apparatus for controlling a compressor according to an embodiment may include a capacitor voltage detector that detects voltage values of a capacitor connected to a reciprocating compressor, a drive voltage detector that detects voltage values of a drive that drives the compressor according to a predetermined control signal, and a microcomputer that calculates a motor current flowing in the reciprocating compressor by changing the voltage values of the capacitor according to the detected voltage values of the drive and performing a definite integral (or performing section-integration) on the voltage values of the capacitor.

Figure 7:
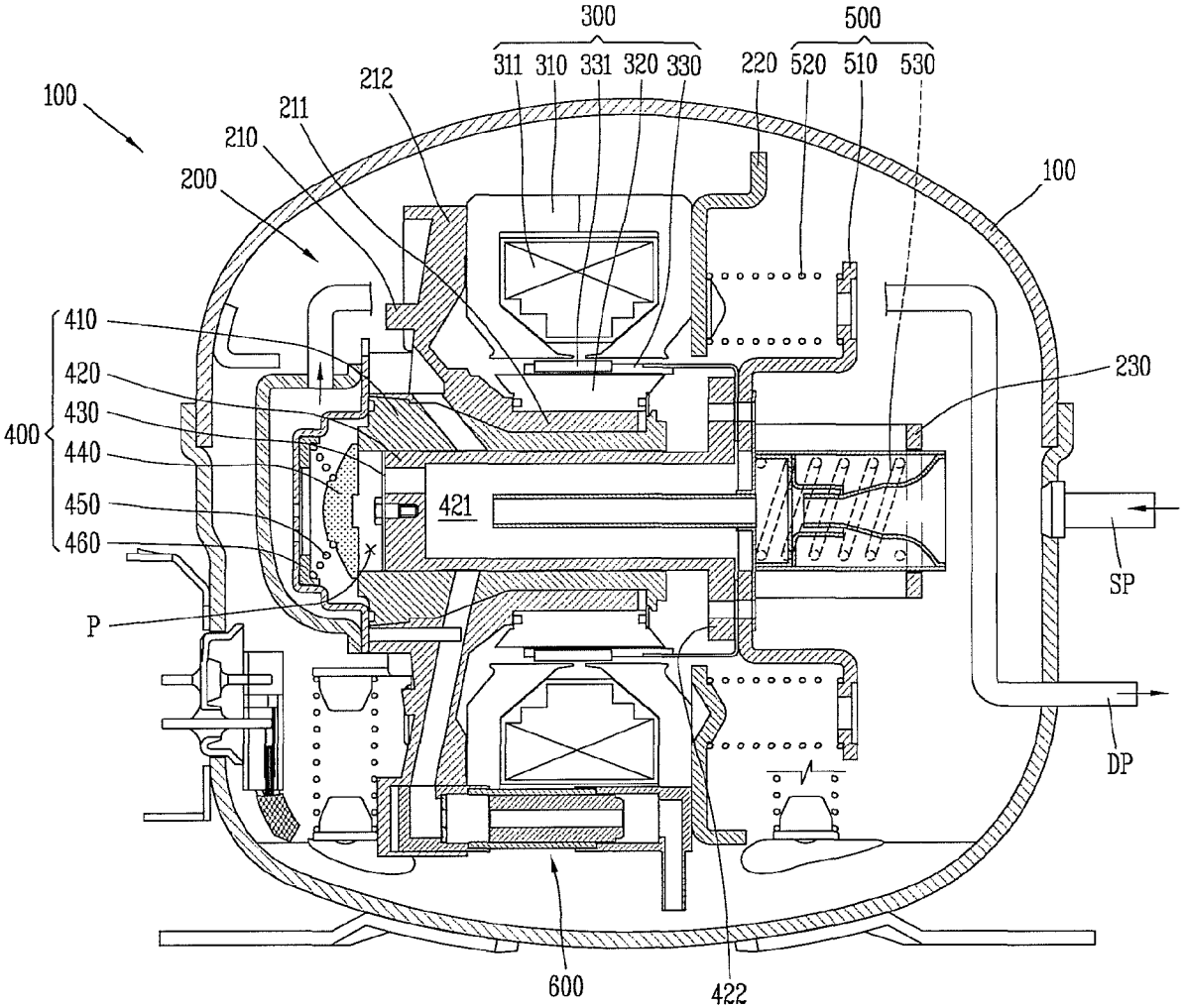
FIG. 7 is a cross-sectional view of a reciprocating compressor included in an apparatus for controlling a compressor according to embodiments.

First, a reciprocating compressor according to embodiments will be described in detail with reference to FIG. 7. The reciprocating compressor 100 of FIG. 7 may include a casing 800, to which a gas suction pipe SP and a gas discharge pipe DP may be connected, a frame 200 elastically supported within the casing 800, a motor 300 supported by the frame 200 and having a mover 330 that linearly reciprocates, a compression device 400 having a piston 420 coupled to the mover 330 of the motor 300 and supported by the frame 200, and a plurality of resonance devices 500, that elastically supports the mover 330 of the motor 300 and the piston 420 of the compression 400 in a motion direction to induce a resonant movement.

The frame 200 may include a first frame 210 that supports the compression device 400 and a front side of the motor 300, a second frame 220 coupled to the first frame 210 that supports a rear side of the motor 300, and a third frame 230 coupled to the second frame 220 that supports a plurality of second resonance springs 530. The first frame 210, the second frame 220, and the third frame 230 may be made of a non-magnetic material, such as aluminum, to reduce iron loss.

The first frame 210 may include a frame part 211 formed to have an annular plate shape, and a cylinder part 212 having a cylindrical shape integrally formed to extend to a rear side, namely, toward the motor 300, such that a cylinder 410 may be inserted at a center of the frame part 211. The frame part 211 may be formed such that an outer diameter thereof is not at least smaller than an inner diameter of an outer stator 310 of the motor 300 in order to support both the outer stator 310 and an inner stator 320 of the motor 300.

The inner stator 320 may be insertedly fixed to an outer circumferential surface of the cylinder part 212. The first frame 210 may be made of a non-magnetic material, such as aluminum, to prevent a loss of magnetic force. The cylinder part 212 may be integrally formed with cylinder 410 by, for example, an insert-dicasting technique. However, the cylinder 410 may be press-fit to an inner circumferential surface of the cylinder part 212, or the inner circumferential surface of the cylinder part 212 may be threaded to screw-assemble the cylinder 410. The cylinder part 212 may have a step surface or a sloped surface between a front inner circumferential surface and a rear inner circumferential surface to allow the cylinder 410 coupled to the inner circumferential surface of the cylinder part 212 to be supported in a direction of the piston 420, and this may be advantageous in terms of stability of the cylinder 410.

The motor 300 may include the outer stator 310, which may be supported between the first frame 210 and the second frame 220 and have a coil 311 wound therearound, the inner stator 320 coupled to an inner side of the outer stator 310 with a certain gap therebetween and insertedly positioned on the cylinder part 212, and the mover 330 including a magnet 331 corresponding to the coil 311 of the outer stator 310 and making a linear reciprocal movement in a magnetic flux direction between the outer stator 310 and the inner stator 320. The outer stator 310 and the inner stator 320 may be formed, for example, by laminating a plurality of sheets of thin stator cores to have a cylindrical shape or by laminating a plurality of sheets of thin stator cores to have a block shape and radially laminating the stator blocks.

The compression device 400 may include the cylinder 410, which may be integrally formed with the first frame 210, the piston 420 coupled to the mover 330 of the motor 300 that makes a reciprocal movement in a compression space P of the cylinder 410, a suction valve 430 installed on a front end of the piston 420 that adjusts suction of a refrigerant gas by opening and closing a suction flow path 421 of the piston 420, a discharge valve 440 installed at a discharge side of the cylinder 410 that adjusts discharging of a compression gas by opening and closing the compression space P of the cylinder 410, a valve spring 450 that elastically supports the discharge valve 440, and a discharge cover 460 fixed to the first frame 210 at the discharge side of the cylinder 410, such that the discharge valve 440 and the valve spring 450 may be accommodated.

The cylinder 410 may be a cylindrical shape and be insertedly coupled to the cylinder part 212 of the first frame 210. The cylinder 410 may form a bearing surface with the piston 420 having an inner circumferential surface made of, for example, cast iron, and in order to avoid abrasion of the cylinder 410 by the piston 420, the cylinder 410 may be made of a material having a higher hardness than that of the first frame 210, more specifically, the cylinder part 212.

The piston 420 may be made of the same material as that of the cylinder 410, or may be made of a material having a hardness which is at least similar to that of the cylinder 410 to reduce abrasion with the cylinder 410. The suction flow path 421 may be formed to penetrate an interior of the piston 420 to allow a refrigerant to be sucked into the compression chamber P of the cylinder 410.

The resonance device 500 may include a spring supporter 510 coupled to a connection portion of the mover 330 and the piston 420, first resonance springs 520 supported by a front side of the spring supporter 510, and second resonance springs 530 supported by a rear side of the spring supporter 510.

Reference numeral 422 denotes a piston connection portion and reference numeral 600 denotes an oil feeder.

When power is applied to the motor 300 and magnetic flux is formed between the outer stator 310 and the inner stator 320, the mover 330 placed in an air gap between the outer stator 310 and the inner stator 320 may move in a direction of the magnetic flux and continuously make a reciprocal movement by the resonance device 500. When the piston 420 makes a backward movement within the cylinder 410, a refrigerant filled in the internal space of the casing 800 may be sucked into the compression space P of the cylinder 410 through the suction flow path 421 of the piston 420 and the suction valve 430. When the piston 420 makes a forward movement within the cylinder 410, the refrigerant gas sucked into the compression space P may be compressed and open the discharge valve 440 so as to be discharged. This sequential process may be repeatedly performed.

Figure 8:
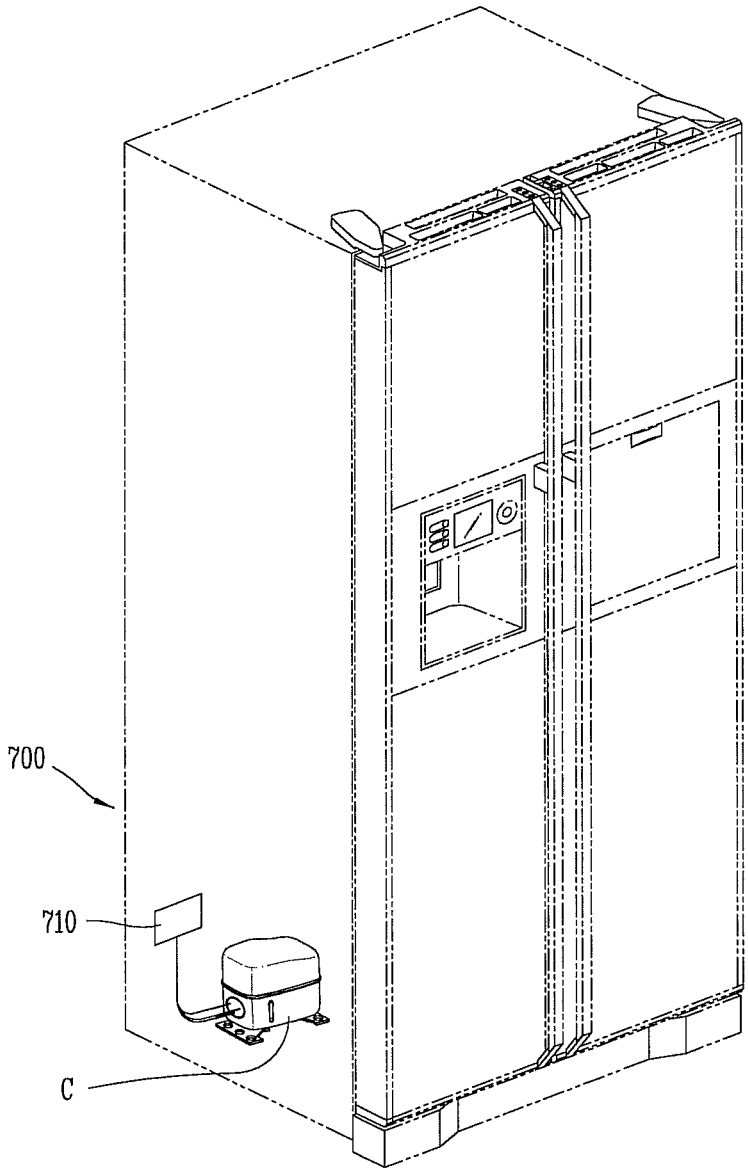
FIG. 8 is a perspective view of a refrigerator employing the reciprocating compressor of FIG. 7.

The reciprocating compressor according to embodiments may include an apparatus for controlling a compressor as follows. Also, the reciprocating compressor may be used in refrigeration equipment, such as a refrigerator or an air-conditioner. For example, referring to FIG. 8, in a refrigeration equipment 700 having a refrigerant compression type refrigerating cycle including a compressor, a condenser, an expander, and an evaporator, a main board 710 that controls a general operation of the refrigeration equipment 700 may be provided, and the reciprocating compressor C may be connected to a main board 710. The apparatus for controlling a compressor may be provided in the main board 710.

Figure 5:
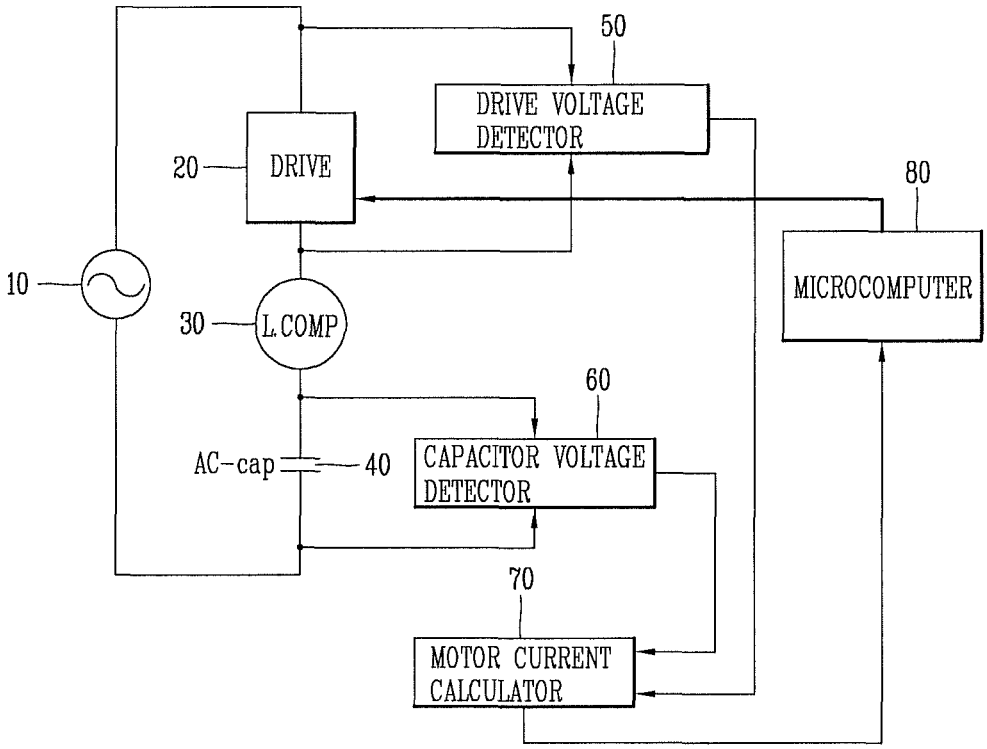
FIG. 5 is a schematic diagram of an apparatus for controlling a compressor according to an embodiment.

Hereinafter, an apparatus for controlling a compressor, which may include the reciprocating compressor 100 as described above, according to embodiments, will be described in detail with reference to FIG. 5. As illustrated, the apparatus for controlling the reciprocating compressor, for example, a linear compressor, may include a commercial power source 10, a drive 20, a compressor 30 (100), an alternating current (AC) capacitor 40, a microcomputer 80, a drive voltage detector 50, and a capacitor voltage detector 60. Also, the apparatus for controlling a compressor may further include a motor current calculator 70 that calculates a motor current value flowing in the compressor 30. However, such a configuration may be modified as necessary.

The commercial power source 10 may supply power to the compressor 30. Upon receiving power from the commercial power source 10, the compressor 30 may perform a reciprocal movement of a piston. The commercial power 10 may be, for example, AC power of 220V which is generally used in households.

The drive 20 may drive the compressor 30 based on a control signal transferred from the microcomputer 80. In more detail, the drive 20 may be connected to the compressor 30 in series and operate the compressor 30 according to a gate driving signal or a pulse width modulation (PWM) signal received from, for example, the microcomputer 80. Also, in preparation for malfunction due to, for example, an error, the drive 20 may further include a breaker (not shown), for example, a mechanical switch or a protection relay, in order to protect the drive 20.

Also, the drive 20 may be, for example, a triac or an inverter. In one embodiment, when the drive 20 is a triac, the microcomputer 80 may vary a firing angle of the triac and transmit a switching signal for controlling a switching operation of the triac to the triac, and upon receiving the switching signal, the triac may adjust an ON/OFF period of switching thereof to operate the compressor 30. In another embodiment, when the drive 20 is an inverter, the inverter may receive a generated pulse width modulation (PWM) signal from the microcomputer 80 and vary, for example, a driving frequency, a voltage, and a stroke, according to the received pulse width modulation signal, to operate the compressor 30.

The AC capacitor 40 may be connected to the compressor 30 in series to cope with an overload. In one embodiment, when a plurality of AC capacitors 40 are provided, a switch (not shown) may be further provided to selectively connect the AC capacitor 40 in parallel according to a control signal from the microcomputer 80. Also, the AC capacitor 40 may have a capacitance corresponding to an inductance of a coil wound in the motor of the compressor 30. Here, the capacitor 40 is described as an AC capacitor (AC-cap), for example; however, embodiments are not limited thereto.

The drive voltage detector 50 may detect a magnitude of a voltage applied to the drive 20. Voltage values of the drive 20 detected by the drive voltage detector 50 may be provided to the microcomputer 80 and used to calculate a value of a motor current flowing in the compressor 30.

Also, the capacitor voltage detector 60 may detect a magnitude of a voltage applied to the AC capacitor 40. The voltage values detected by the capacitor voltage detector 60 may be provided to the microcomputer 80 and used to calculate a motor current value flowing in the compressor 30.

The microcomputer 80 may calculate a value of a motor current flowing in the compressor 30 using the voltage values of the drive 20 detected by the drive voltage detector 50 and the voltage values of the AC capacitor 40 detected by the capacitor voltage detector 60.

In more detail, the microcomputer 80 may convert the voltage values of the capacitor 40 detected by the capacitor voltage detector 60 according to the voltage values of the drive 20 detected by the drive voltage detector 50. When the voltage values of the drive 20 detected by the drive voltage detector 50 are not 0, the microcomputer 80 may forcibly change the corresponding voltage value of the capacitor 40 into 0, and when the detected voltage values of the drive 20 is 0, the microcomputer 80 may maintain the corresponding voltage values of the capacitor 40 as is. Thereafter, the microcomputer 80 may perform a definite integral on the voltage values of the capacitor 40 to calculate a value of the motor current flowing in the compressor 30. In more detail, at a point or in a section in which voltage values of the drive 20 detected by the drive voltage detector 50 are not 0, a motor current value may be calculated as 0, and at a point or in a section in which voltage values of the drive 20 detected by the drive voltage detector 50 are 0, a value obtained by integrating (or performing a integral on) the detected voltage values of the capacitor 40 may be calculated as a motor current value. When the value of the motor current flowing in the compressor 30 is calculated using the detected voltage values of the capacitor 40 and the voltage values of the drive 20, a sensor that senses the motor current is not required, reducing costs.

Figure 2:
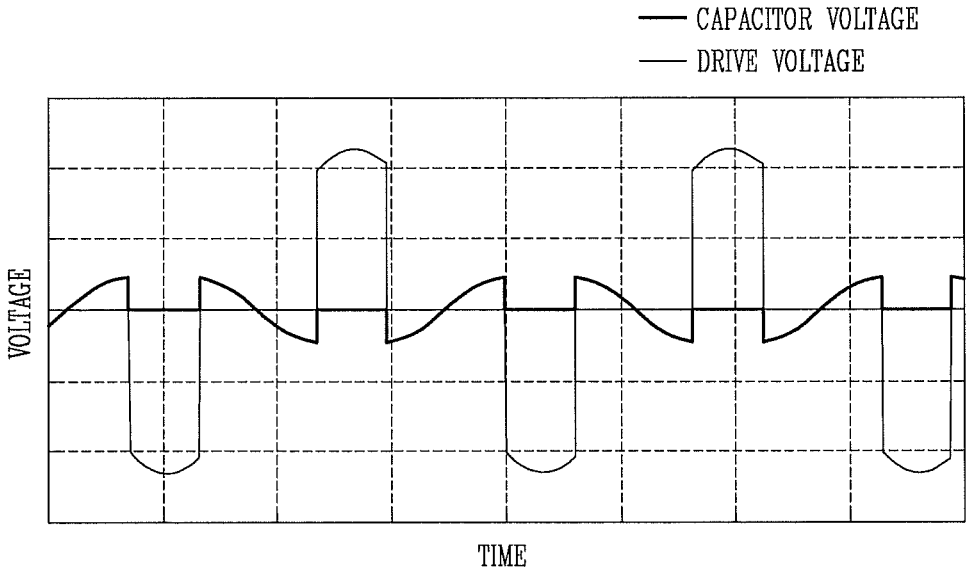
FIG. 2 is a graph in which capacitor voltage values of FIG. 1 are changed.
Figure 3:
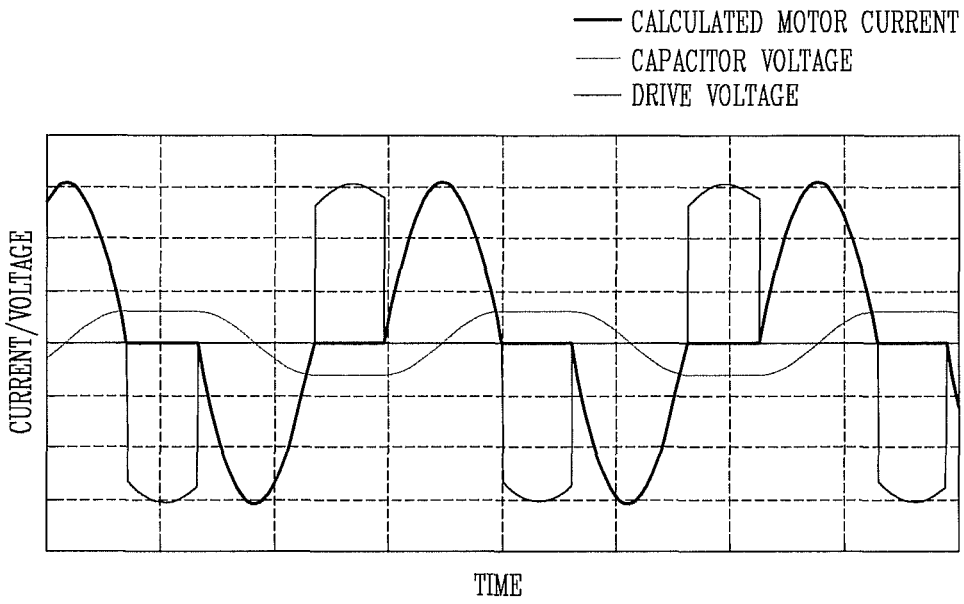
FIG. 3 is a graph showing a motor current calculated by performing a definite integral on the capacitor voltage values of FIG. 2.
Figure 4A:
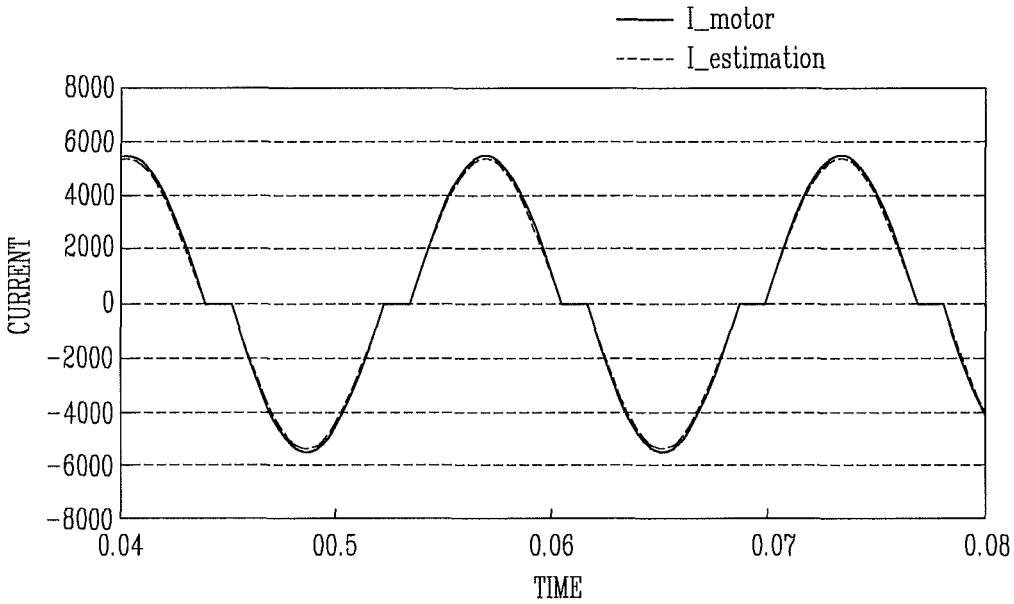
FIGS. 4A to 4D are graphs showing examples of motor currents calculated according to control conditions of a drive.
Figure 4B:
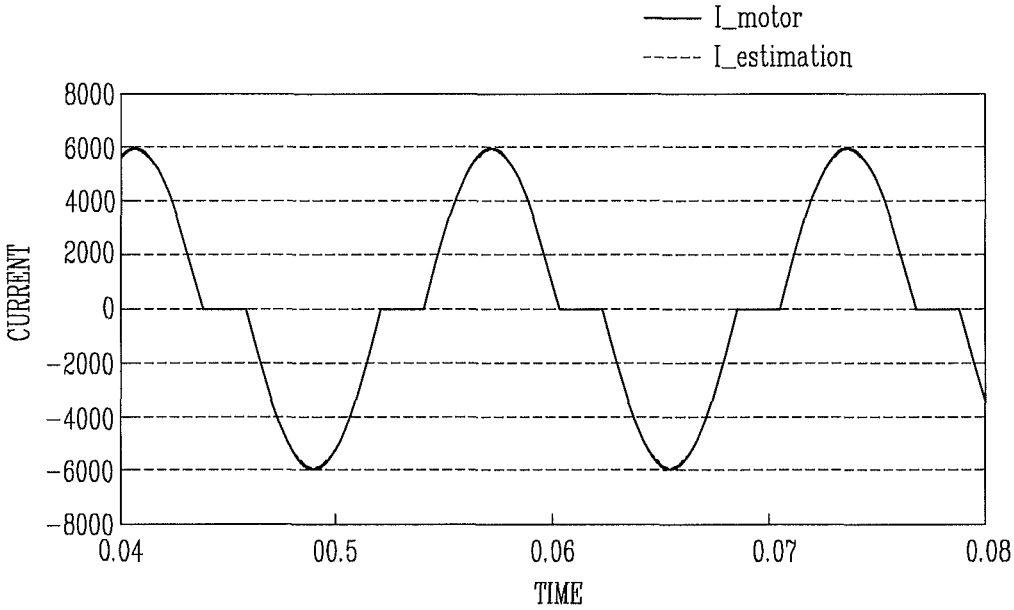
Figure 4C:
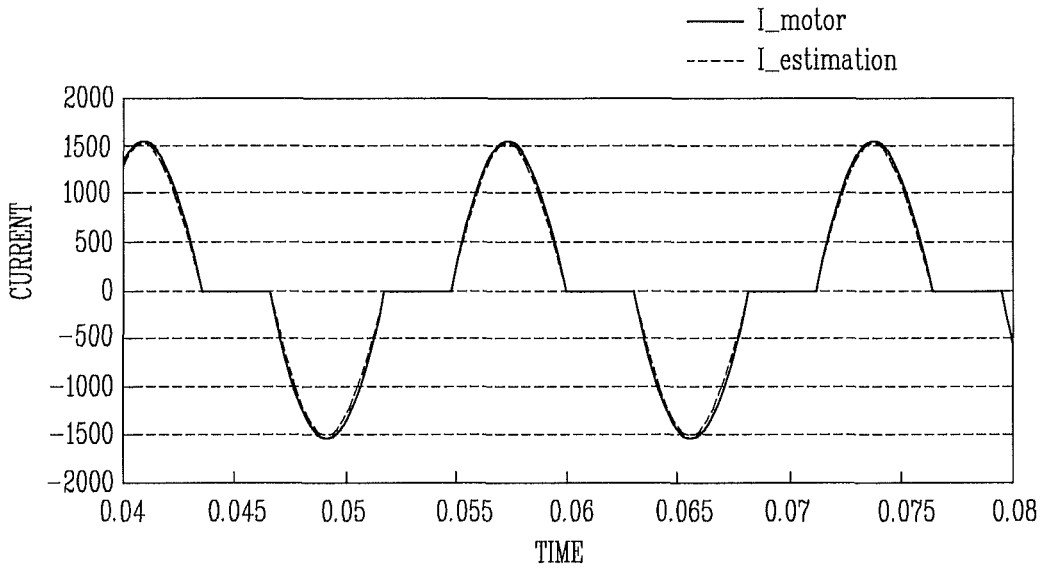
Figure 4D:
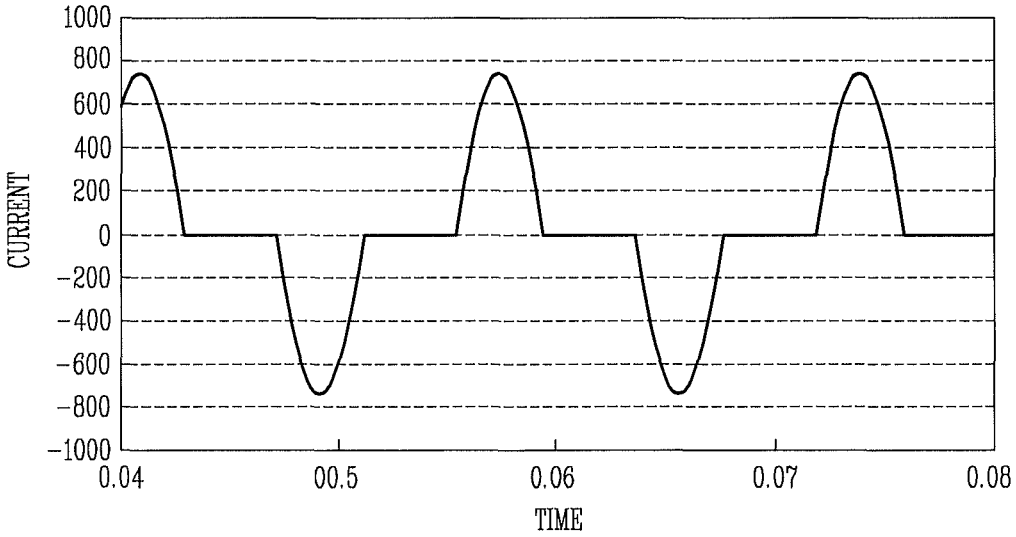

FIGS. 1 to 3 are graphs showing a process of calculating a motor current value using capacitor voltage values and drive voltage values in an apparatus for controlling a compressor according to an embodiment.

As illustrated in FIG. 1, voltage values of the capacitor 40 and the drive 20 detected through the voltage detectors 50 and 60 are illustrated as waveforms. In FIG. 1, the voltage values of the capacitor 40 corresponding to a section in which the voltage values of the drive 20 are not 0 are all forcibly converted into 0. The application results are illustrated in FIG. 2. Thereafter, the converted capacitor voltage values illustrated in FIG. 2 are integrated in each section to obtain motor current values having a sin waveform. The corresponding results are illustrated in FIG. 3.

A motor equation of the compressor 30 and a voltage equation of the capacitor 40 are as follows.

$$V_{in} = Ri_m + L\frac{di_m}{dt} + \frac{1}{C}\int i_m dt + K\frac{dx}{dt}, \left(V_{Cap} = \frac{1}{C}\int i_m dt\right)$$

Here, $V_{in}$ is an input voltage of commercial power, and $V_{cap}$ is a voltage of the capacitor. Also, im is a motor current flowing in the compressor, R is internal resistance of the compressor, L is an inductance of the motor coil of the compressor, K is a motor constant, C is capacitance forming a resonant circuit together with L.

The value of the motor current flowing in the compressor 30 may be derived from the motor equation and the voltage equation of the capacitor 40 as follows.

$$i_m = \int (C \cdot V_{cap}) dt / (2 \cdot \pi \cdot f)^2$$

Here, $i_m$ is a motor current flowing in the compressor, C is capacitance, and $V_{cap}$ is a voltage of the capacitor. 2πf is a variable value of a firing angle when the drive 20 is a triac.

In this manner, the value of the motor current value obtained by converting the detected voltage values of the capacitor and performing a definite integral thereon may have enhanced resolution and be more resistant to noise. For example, in the related art case of calculating a value of a motor current of the reciprocating compressor through a differentiator or a differential circuit, a capacitor voltage is required to be regulated to reinforce resolution or a re-designing process is required to filter noise. In comparison, with embodiments disclosed herein, when the value of the motor current is calculated by appropriately converting the detected voltage values of the capacitor according to voltage values of the drive and performing a definite integral thereon, noise and resolution may be improved.

Also, the microcomputer 80 may include a motor current calculator 70. When the detected voltage values of the drive 20 are not 0, the motor current calculator 70 may change the corresponding voltage values of the capacitor into 0 and output a value obtained by performing a definite integral on the voltage values of the capacitor, as the motor current value. The motor current calculator 70 may be positioned within the microcomputer 80 or independently provided, or the foregoing process of calculating the motor current may be implemented by software or hardware.

Also, the apparatus for controlling a compressor according to embodiments disclosed herein may further include a motor voltage detector (not shown) that detects a motor voltage applied to the compressor 80, and the microcomputer 80 may calculate a stroke of the compressor 30 using a motor voltage detected by the motor voltage detector and the motor current values calculated through the foregoing process.

In addition, the apparatus for controlling a compressor according to embodiments disclosed herein may further include a rectifier (not shown) that rectifies power from the commercial power 10 supplying power to the compressor 30.

Meanwhile, when the drive 20 is a triac, the microcomputer 80 may generate a control signal for regulating a firing angle of the triac based on the motor current value calculated in the manner as described above, in order to generate a switching signal of the triac. In more detail, in order to supply a motor current having a sufficiently small value to the compressor 30, the microcomputer 80 may generate a control signal for increasing a firing angle of the triac, and in order to supply a motor current having a relatively large value to the compressor 30, the microcomputer 80 may generate a control signal for reducing a firing angle of the triac. FIGS. 4A to 4D show waveforms of motor currents calculated according to control conditions of the triac. It may be seen that a peak value of the calculated motor current may be reduced as the firing angle for controlling a switching operation of the triac is increased. Namely, according to the following motor current generating equation, when a size of the firing angle is increased, a peak value of the calculated motor current is reduced in a multiple manner, and when the size of the firing angle is reduced, the peak value of the calculated motor current is increased in a multiple manner.

$$i_m = \int (C \cdot V_{cap}) dt / (2 \cdot \pi \cdot f)^2$$

In this manner, in the case of the apparatus for controlling a compressor according to embodiments, without the necessity of a sensor, a motor current flowing in the compressor may be calculated from voltage values of the capacitor and a motor current value may be obtained by performing a definite integral on the voltage values of the capacitor. Thus, the motor current value is resistant to noise and stable, relative to that based on a related art differentiator or differentiation circuit.

Figure 6:
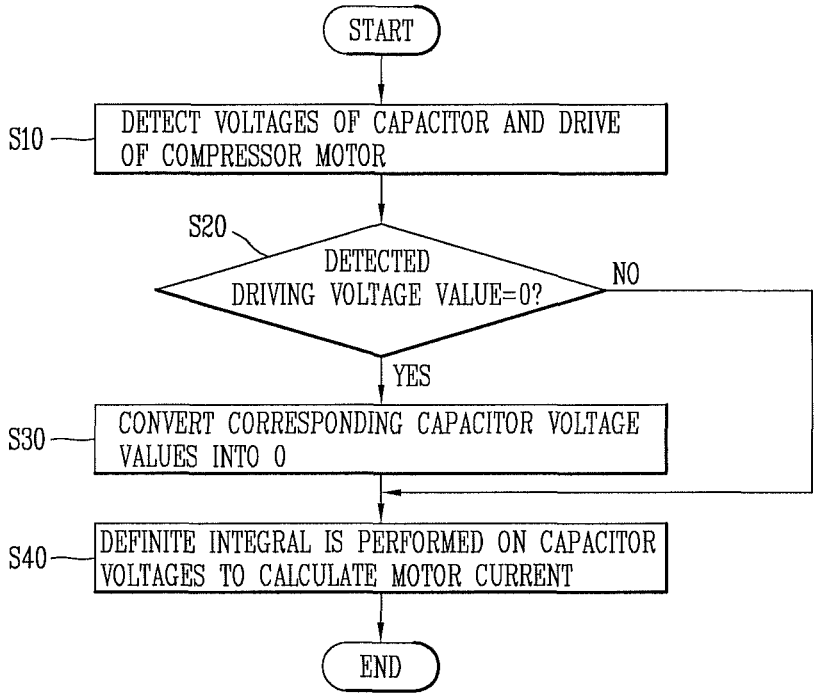
FIG. 6 is a flow chart of a method for controlling a compressor according to an embodiment.

A method for controlling a compressor according to an embodiment will be described with reference to FIGS. 5 and 6.

In general, in a reciprocating compressor, a piston moves vertically by an application voltage according to a stroke reference value set by a user, and thus, a stroke is varied to regulate freezing capacity. The drive 20 may operate the compressor by changing a turn-on period of gate driving or changing a voltage according to a switching control signal or a pulse width modulation signal transferred from the microcomputer 80.

In a method for controlling a compressor according to an embodiment, first, voltage values of the drive 20 and the capacitor 40 connected to the motor of the compressor 30 may be detected, respectively, in step S10. In more detail, a drive voltage may be detected by the drive voltage detector 50 and a capacitor voltage may be detected by the capacitor voltage detector 60 and provided to the microcomputer 80. Thereafter, the detected voltage of the drive 20 may be monitored and the voltage values of the capacitor 40 may be changed according to the corresponding value, in step S20. When the detected voltage values of the drive 20 are not 0, corresponding voltages of the capacitor 40 may be forcibly converted into 0, in step S30. Then, a definite integral may be performed on corresponding voltage values of the capacitor 40 to calculate a motor current value flowing in the compressor 30, in step S40. Based on the calculated motor current, driving of the compressor may be controlled. Meanwhile, when the detected voltages of the drive are not 0 in step S20, step S40 may be performed.

Also, in the method for controlling a compressor according to embodiments, a motor voltage applied to the reciprocating compressor may be detected by a predetermined unit. By using the detected motor voltage and the motor current value calculated through the foregoing process, a stroke of the reciprocating compressor may be calculated. The calculated stroke and a predetermined stroke reference value may be compared, and an operation of the drive may be controlled according to the comparison result, thus operating the compressor.

Meanwhile, when the drive 20 is a triac, a firing angle of a switching control signal for controlling switching of the triac may be regulated according to the comparison result obtained by comparing the calculated stroke and the predetermined stroke reference value. In more detail, when the stroke is smaller than the stroke reference value, the microcomputer 80 may output a switching control signal for lengthening an ON period of the triac to increase a voltage applied to the compressor 30. Meanwhile, when the calculated stroke is greater than the stroke reference value, a voltage of the triac may be changed to reduce the firing angle of the switching control signal.

Also, when the drive 20 is an inverter, a pulse width modulation signal applied to the inverter may be regulated according to the comparison result obtained by comparing the calculated stroke and the predetermined stroke reference value. Thereafter, the inverter may control driving of the compressor by changing a voltage, and a frequency, according to the received pulse width modulation signal.

As described above, in the case of the apparatus for controlling a compressor and the method for controlling a compressor according to embodiments, a motor current flowing in the compressor may be calculated from voltage values of the capacitor without using a sensor, and a motor current value may be calculated by performing a definite integral on a capacitor voltage values, such that the motor current value may be resistant to noise and stable.

Embodiments disclosed herein provide an apparatus for controlling a compressor capable of calculating a motor current flowing in a compressor without using a sensor, and a method for controlling a compressor.

Embodiments disclosed herein provide an apparatus for controlling a compressor capable of calculating a motor current which is resistant to noise, stable, and accurate, using a detected capacitor voltage value, and a method for controlling a compressor.

Embodiments disclosed herein provide an apparatus for controlling a compressor that may include a capacitor voltage detection unit or detector that detects a voltage value of a capacitor connected to a reciprocating compressor; a driving unit or driver voltage detection unit or detector that detects a voltage value of a driving unit or drive that drives the reciprocating compressor according to a control signal; and a microcomputer that calculate a motor current flowing in the reciprocating compressor by changing the voltage value of the capacitor according to the detected voltage value of the driving unit and performing a definite integral (or performing section-integration) on the voltage value of the capacitor.

The driving unit may be an inverter unit or inverter, and the control signal may be a pulse width modulation signal. The driving unit may be a triac, and the control signal may be a switching signal of the triac.

The microcomputer may generate a control signal to adjust a firing angle of the triac based on the calculated motor current. The microcomputer may include a motor current calculation unit or calculator that changes a corresponding voltage of the capacitor into 0 and performs a definite integral on the voltage of the capacitor to output the motor current, when the detected voltage value of the driving unit is not 0.

The apparatus for controlling a compressor according to embodiments may further include a commercial power source that supplies power to the reciprocating compressor, and a rectifying unit or rectifier that rectifies power from the commercial power source.

The apparatus for controlling a compressor according to embodiments may further include a motor voltage detection unit or detector that detects a motor voltage applied to the reciprocating compressor. The microcomputer may calculate a stroke of the reciprocating compressor using the detected motor voltage and the calculated motor current.

Embodiments disclosed herein provide a method for controlling a compressor that may include detecting a voltage of a driving unit or drive connected to a reciprocating compressor and a voltage of a capacitor; changing the voltage value of the capacitor according to the detected voltage value of the driving unit; performing a definite integral on the voltage value of the capacitor to calculate a motor current flowing in the reciprocating compressor; and controlling driving of the reciprocating compressor based on the calculated motor current. In the changing of the voltage value of the capacitor, when the detected voltage value of the driving unit is not 0, a corresponding voltage value of the capacitor may be changed into 0.

The method according to embodiments may further include detecting a motor voltage applied to the reciprocating compressor; calculating a stroke of the reciprocating compressor using the detected motor voltage and the calculated motor current value; and comparing the stroke with a predetermined stroke reference value and controlling an operation of the driving unit according to the comparison result. In the controlling of an operation of the driving unit, when the driving unit is a triac, a firing angle of a switching control signal for controlling switching of the triac may be controlled according to the comparison result. Further, in the controlling of an operation of the driving unit, when the driving unit is an inverter, a pulse width modulation signal of the inverter may be controlled according to the comparison result.

In the case of the apparatus for controlling a compressor and a method for controlling a compressor according to embodiments, as a motor current flowing in the compressor is calculated from a voltage value of the capacitor without using a sensor, costs may be reduced.

Also, in the case of the apparatus for controlling a compressor and a method for controlling a compressor according to embodiments, a value of the motor current may be calculated through arithmetic operation (that is, computation or calculation), and the calculated motor current value may be resistant to noise and stable.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An apparatus for controlling a compressor, the apparatus comprising:

a capacitor voltage detector that detects voltage values of a capacitor connected to the compressor;

a drive voltage detector that detects voltage values of a drive that drives the compressor according to a control signal;

a microcomputer that calculates a motor current flowing in the compressor by changing the voltage values of the capacitor according to the detected voltage values of the drive and performs a definite integral on the voltage values of the capacitor; and a motor voltage detector that detects a motor voltage applied to the compressor, wherein the microcomputer calculates a stroke of the compressor using the detected motor voltage and the calculated motor current.

2. The apparatus of claim 1, wherein the drive is an inverter and the control signal is a pulse width modulation signal.

3. The apparatus of claim 1, wherein the microcomputer comprises a motor current calculator that changes a corresponding voltage of the capacitor into 0 and performs the definite integral on the voltage values of the capacitor to output the motor current, when the detected voltage values of the drive are not 0.

4. The apparatus of claim 1, further comprising:

a commercial power source that supplies power to the compressor; and a rectifyier that rectifies the power from the commercial power source.

5. The apparatus of claim 1, wherein the compressor comprises a reciprocating compressor.

6. An apparatus for controlling a compressor, the apparatus comprising:

a capacitor voltage detector that detects voltage values of a capacitor connected to the compressor;

a drive voltage detector that detects voltage values of a triac that drives the compressor according to a control signal; and a microcomputer that calculates a motor current flowing in the compressor by changing the voltage values of the capacitor according to the detected voltage values of the triac and performs a definite integral on the voltage values of the capacitor.

7. The apparatus of claim 6, wherein the control signal is a switching signal of the triac.

8. The apparatus of claim 7, wherein the microcomputer generates a control signal to adjust a firing angle of the triac based on the calculated motor current.

9. The apparatus of claim 6, wherein the microcomputer comprises a motor current calculator that changes a corresponding voltage of the capacitor into 0 and performs the definite integral on the voltage values of the capacitor to output the motor current, when the detected voltage values of the triac are not 0.

10. The apparatus of claim 6, further comprising:

a commercial power source configured to supply power to the compressor; and a rectifyier that rectifies the power from the commercial power.

11. The apparatus of claim 6, further comprising:

a motor voltage detector that detects a motor voltage applied to the compressor, wherein the microcomputer calculates a stroke of the compressor using the detected motor voltage and the calculated motor current.

12. The apparatus of 6, wherein the compressor comprises a reciprocating compressor.

13. A method for controlling a compressor, the method comprising:

detecting voltage values of a drive connected to the compressor and voltage values of a capacitor;

changing the voltage values of the capacitor according to the detected voltage values of the drive;

performing a definite integral on the voltage values of the capacitor to calculate a motor current flowing in the compressor;

controlling driving of the compressor based on the calculated motor current;

detecting a motor voltage applied to the compressor;

calculating a stroke of the compressor using the detected motor voltage and the calculated motor current value; and comparing the stroke with a predetermined stroke reference value and controlling an operation of the drive according to the comparison result.

14. The method of claim 13, wherein in the changing of the voltage values of the capacitor, when the detected voltage values of the drive are not 0, corresponding voltage values of the capacitor are changed into 0.

15. The method of claim 13, wherein in the controlling of an operation of the drive, when the drive is a triac, a firing angle of a switching control signal for controlling switching of the triac is controlled according to the comparison result.

16. The method of claim 13, wherein in the controlling of an operation of the drive, when the drive is an inverter, a pulse width modulation signal of the inverter is controlled according to the comparison result.

17. The method of claim 13, wherein the compressor comprises a reciprocating compressor.

* * * * *